US006064341A

United States Patent [19]

Hassemer

[11] Patent Number: 6,064,341

[45] Date of Patent: May 16, 2000

[54] ANTENNA ASSEMBLY

[75] Inventor: Brian Jon Hassemer, Gurnee, Ill.

[73] Assignee: Motorola, Inc., Schaumburg, Ill.

[21] Appl. No.: 09/078,917

[22] Filed: May 14, 1998

[51] Int. Cl.[7] ..... H01Q 1/24

[52] U.S. Cl. ..... 343/702; 343/901

[58] Field of Search ..... 343/702, 900, 343/901, 906; 455/90; H01Q 1/24

[56] References Cited

U.S. PATENT DOCUMENTS

| | | | |
|---|---|---|---|
| 4,860,024 | 8/1989 | Egashira | 343/702 |
| 5,079,558 | 1/1992 | Koike | 343/702 |
| 5,177,492 | 1/1993 | Tomura et al. . | |
| 5,245,350 | 9/1993 | Sroka | 343/702 |
| 5,335,368 | 8/1994 | Tamura | 455/90 |
| 5,374,937 | 12/1994 | Tsunekawa et al. | 343/702 |
| 5,467,097 | 11/1995 | Toko | 343/702 |
| 5,739,792 | 4/1998 | Hassemer | 343/702 |

FOREIGN PATENT DOCUMENTS

| | | |
|---|---|---|
| 2036677 | 8/1991 | Canada . |
| 617520 | 9/1994 | European Pat. Off. . |

OTHER PUBLICATIONS

U.S. application No. 08/577,460 filed on Dec. 22, 1995, entitled, "Wireless Communication Device Having a Reconfigurable Matching Circuit" in the name of Motorola, Inc. Abandoned.

U.S. application No. 08/960,110 filed on Oct. 27, 1997, entitled, "Wireless Communication Device Having a Reconfigurable Matching Circuit" in the name of Motorola, Inc. (5,754,141).

Federal Communications Commission, Grant of Equipment Authorization, File No. 31010/EQU 17.9, Date of Grant: Nov. 28, 1995; Photograph Exhibit C (pp. 48–49 and photograph 7).

*Primary Examiner*—Hoanganh Le

*Attorney, Agent, or Firm*—John J. King; Daniel R. Collopy

[57] ABSTRACT

An antenna arrangement for a portable radiotelephone (100) is disclosed. In particular, the antenna arrangement generally includes a movable antenna element movable between an extended position and a retracted position, a movable contact (243) movably coupled to a bottom portion of the movable antenna element, the movable contact being movable between an extended position and a retracted position, and a circuit board having a first contact element (236), and a second contact element (238) coupled to ground, the first contact element receiving the movable contact when the movable antenna element is in an extended position, and the second contact element receiving the movable contact when the movable antenna element is in a retracted position for terminating the antenna.

12 Claims, 7 Drawing Sheets

Z
X
Y
5
7
202
118
102
100
130
6
146
116
134
128
106
138
104
113
115
144
6
132
114
110
112
108
140
142
5
7

100
244
226
242
240
236
247
228
RADIO CIRCUIT
C
L1
L2
230
MATCHING CIRCUIT
246
234
224
108
238
250
243
245
CIRCUIT BOARD
HOUSING

ANTENNA ASSEMBLY

FIELD OF THE INVENTION

The present invention relates generally to the field of antenna assemblies for portable communications devices.

BACKGROUND OF THE INVENTION

As portable communication devices such as radiotelephones become smaller and lighter, the required elements of the radiotelephone must be located in a smaller area. One particular element of a radiotelephone is an antenna. Radiotelephones having a retractable compound antennas are known in the art. Some such retractable antennas are capable of receiving signals in both the extended position and retracted position.

Such retactable antennas may also be "collapsible." One type of collapsible antenna is a "telescoping" antenna, such as those commonly found on portable AM/FM radios. Another type of collapsible antenna includes a movable contact. For example, a Sony CMRX100 includes a retractable antenna having a movable contact. As shown in photograph 7 of Exhibit C (Photograph EXHIBIT LIST) in the type acceptance for CMRX100 cellular telephone granted on Nov. 28, 1995 (File No.: 31010/EQU 17.9), a movable contact is positioned at the bottom of the retractable antenna to extend the effective electrical length of the antenna when extended. However, the antenna assembly in the Sony CMRX100 provides coupling only near the top of the antenna when the antenna is in the extended position. However, such a retractable antenna has the disadvantage that the antenna portion within the housing radiates inside the housing when the antenna is in the retractable position, possibly interfering with sensitive electrical components disposed inside the housing.

Accordingly, a need exists for a compact collapsible antenna assembly for a radiotelephone or another wireless communication device.

DETAILED DESCRIPTION OF THE PREFERRED EMBODIMENTS

An antenna arrangement for a portable radiotelephone is disclosed. In particular, the antenna arrangement generally includes a movable antenna element movable between an extended position and a retracted position, a movable contact movably coupled to a bottom portion of the movable antenna element, the movable contact being movable between an extended position and a retracted position, and a circuit board having a first contact element, and a second contact element coupled to ground, the first contact element receiving the movable contact when the movable antenna element is in an extended position, and the second contact element receiving the movable contact when the movable antenna element is in a retracted position for terminating the antenna.

Figure 1:
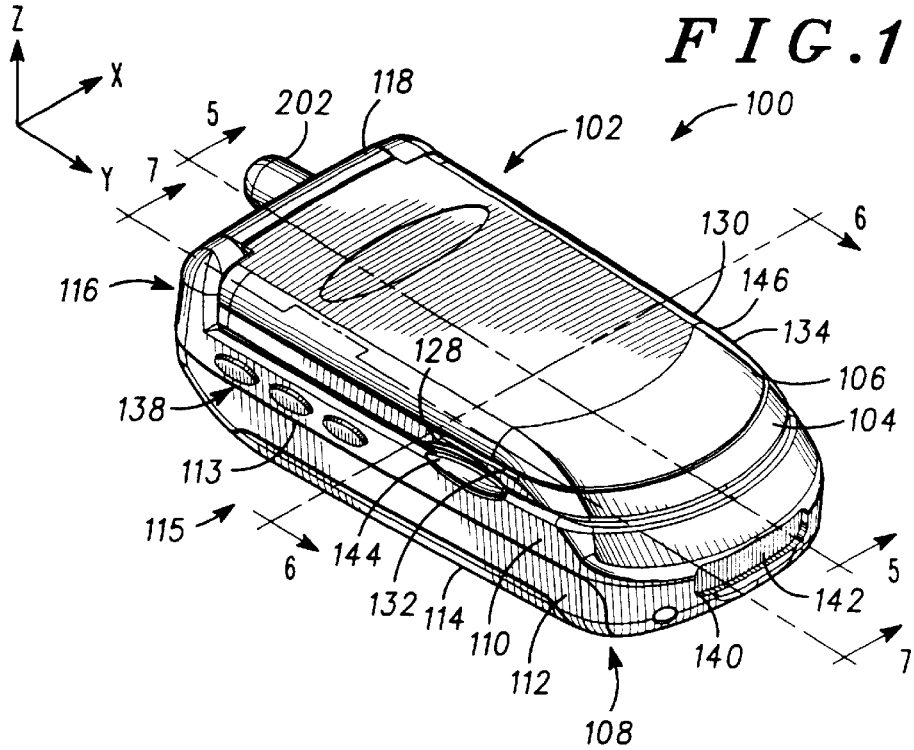
FIG. 1 is a perspective view of a portable radiotelephone in a closed position

FIG. 1 shows a perspective view of a portable radiotelephone 100. Portable radiotelephone 100 is a portable electronic device and, more particularly, a portable electronic device that provides for wireless communication via radio frequency (RF) signals. Portable radiotelephone 100 may be operable in cellular telephone systems and is commonly referred to as a portable cellular telephone.

Portable radiotelephone 100 has an upper housing 102 and a lower housing 108 rotatably connected via a hinge 116. Portable radiotelephone 100 has a closed position, as shown in FIG. 1, and an open position. With such a configuration, portable radiotelephone 100 is commonly referred to as a foldable or clamshell style telephone.

Upper housing 102 is formed by a front housing portion 104 and a rear housing portion 106. Front housing portion 104 forms a barrel 118 of hinge 116. A display lens (visible when open) is preferably carried on upper housing 102 and is substantially flush with a front surface thereof. A finger recess 128 (optional) is formed along the front and a left side surface of upper housing 102, and a finger recess 130 (optional) is formed along the front and a right side surface of upper housing 102. Upper housing 102 also has an ear placement region on the front surface, where an ear of a user is positioned for listening to voice signals from a speaker. Various openings are formed on the front surface within the ear placement region.

Figure 3:
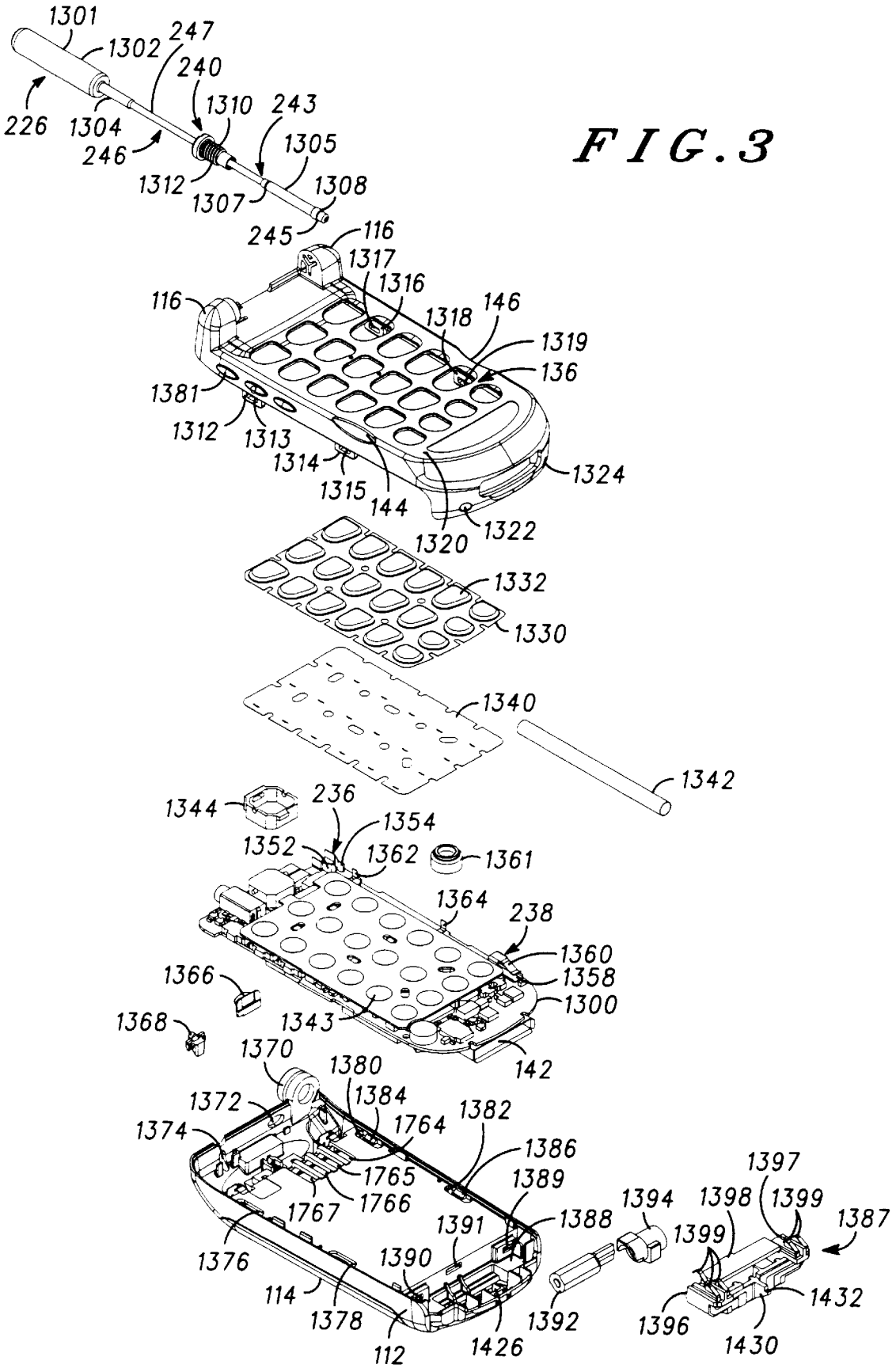
FIG. 3 is an exploded view of the lower housing as viewed from the top, front and right side.

Similar to upper housing 102, lower housing 108 is formed by a front housing portion 110 and a rear housing portion 112. A keypad 130 having a plurality of input keys 132, including conventional telephone keys (0·9, *, and #) and function keys shown in FIG. 3, is exposed on a front surface of lower housing 108 when the phone is open. In addition, a plurality of input keys 138 are exposed on a left side surface of lower housing 108. An antenna 202 is positioned at a top surface of lower housing 108. An opening 140 is formed on a bottom surface of lower housing 108 and exposes an electrical connector 142 provided for communication of input/output data or receiving electrical energy through a cigarette lighter adapter (not shown). A detachable battery cover 114 is detachably carried on a bottom surface of lower housing 108 and covers a battery. A finger recess 144 is formed along the front and the left side surface, and a finger recess 146 is formed along the front and a right side surface of lower housing 108. When portable radiotelephone 100 is in the closed position, finger recesses 128 and 130 meet with finger recesses 144 and 146, respectively, and cooperate to provide assistance for opening portable radiotelephone 100.

Figure 2:
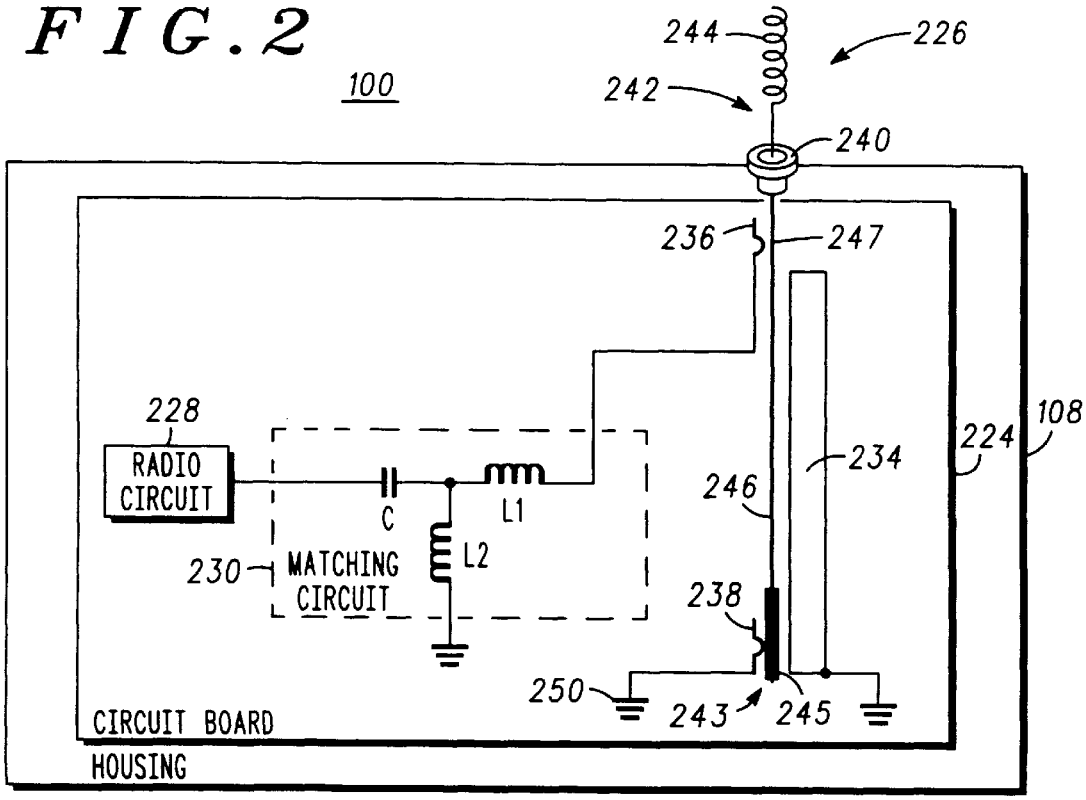
FIG. 2 is a block diagram of a radiotelephone circuit incorporating the antenna assembly present invention.

Turning now to FIG. 2, in one such embodiment configured according to the present invention, a radiotelephone comprises a housing 108; a circuit board 224, an antenna assembly 226, a radio circuit 228, a matching circuit 230, a ground plane 234, an upper contact acting as a feed terminal 236, and an lower contact acting as a ground terminal 238 coupled with a ground. Circuit board 224 is disposed inside housing 222, and radio circuit 228, matching circuit 230, ground plane 234, feed terminal 236, and ground terminal 238 can be disposed on circuit board 224.

Antenna assembly 226 includes a bushing 240 and an antenna, e.g., a compound antenna 242 having a first antenna portion, e.g., at least a helical coil 244, and a second antenna portion, e.g., at least a portion of the rod portion 246. The first antenna portion is carried by the second antenna portion and can be electrically coupled, e.g., by direct electrical contact, to the second antenna portion. Bushing 240 can be affixed to housing 222, and compound antenna 242 is moveable within bushing 240 from a retracted position as shown in FIG. 2 to an extended position. As will be described in more detail in the remaining figures, a movable contact 243 is located near the bottom of rod portion 246.

In the extended position the first antenna portion is located outside of the housing and the second antenna portion is substantially located outside of the housing. Further, a first coupling location 245 of the antenna, e.g., the lower end of the second antenna portion, is electrically coupled, e.g., in direct electrical contact, with feed terminal 236. In the retracted position, the first antenna portion is located substantially outside of housing 222, and the second antenna portion is located inside housing 222 and in close proximity to ground plane 234. Further, feed terminal 236 is electrically coupled, for example by capacitive coupling as shown, with a second coupling location 247 of the antenna, e.g., the lower end of the first antenna portion, and ground terminal 238 is electrically coupled, e.g., in direct electrical contact, with first coupling location 245. Although capacitive and direct coupling are shown for the second coupling location and the first coupling location respectively, each coupling location could be coupled by some other means than that shown.

Compound antenna 242 has many parameters representative of the position of the compound antenna 242, the physical location of compound antenna 242 relative to housing 222 or feed terminal 236, the electrical impedance of compound antenna 242, or the strength of the electrical signal that compound antenna 242 receives.

Radio circuit 228 can be, e.g., a duplexer, a transmitter, a receiver, a modulator, a demodulator, or traces connecting the components of radio circuit 228, or some combination of these components and traces.

Matching circuit 230 is coupled between feed terminal 236 and radio circuit 228. Matching circuit 230 can be, e.g., a T-connected circuit with a capacitor C in one arm, an inductor $L_1$ in the other arm, and a ground-terminated inductor $L_2$ in the leg.

Those skilled in the art will recognize that various modifications and variations, in addition to those already described, can be made in the radiotelephone of the present invention and in construction of this radiotelephone without departing from the scope or spirit of this invention.

As examples, the demarcation between the first antenna portion and the second antenna portion can be defined by an area where feed terminal 236 couples with the antenna in the retracted position. Accordingly, the first antenna portion can be any part of rod portion 246, or all of rod portion 246 and a part of helical coil 244. Furthermore, the first antenna portion and second antenna portion can be radiating elements of different shapes. Also, instead of the second antenna portion being a quarter wavelength, ground terminated and adjacent a ground plane, it can be of a different wavelength, terminated with an impedance, or surrounded by a conductive tube that is grounded. Also, the feed contact and bushing can be the same component, and the feed contact, or the ground contact can be disposed on the housing or a component inside the housing.

Turning now to FIG. 3, an exploded perspective view shows the lower housing 108 according to the present invention. In particular, an antenna assembly 226 adapted to be coupled to the lower housing has a top portion 1301. The top portion is covered by a sleeve 1302 having a lower sleeve portion 1303. Top portion 1301 is also connected to a rod portion 246 which extends to a movable contact 243 having an upper contact portion 1305, a shoulder portion 1307 and a flange 1308. The antenna also includes a bushing 240 having threaded portion 1312. The coupling of the antenna will be described in more detail in reference to FIGS. 4–6, and the structure of the antenna will be described in more detail in reference to FIGS. 7–8.

Front housing portion 110 further includes a hoop 1312 having a recess 1313, a hoop 1314 having a recess 1315, a hoop 1316 having a recess 317, and a hoop 1318 having a recess 1319. As will be apparent, the hoops are designed to intermate with snaps of lower housing 112. Front housing portion 110 further includes a microphone port 1320 and recesses 1322 and 1324 for receiving a detachable battery which will be described in more detail in the remaining figures. A keypad 1330 having keys 136 is shown below front housing portion 110. A mylar sheet 1340 having poppies fits between the keypad and keyboard 1343. An alert device grommet 1344 fits over an alert device 1346. Transceiver board 1300 also includes feed terminal 236 having a first contact element 1352 and a second contact element 1354, and a ground terminal 238 having a lower contact portion 1358 connected to the transceiver board and an upper contact portion 1360. A microphone grommet 1361 covers a microphone 1363 attached to transceiver board 1300. The transceiver board also includes antenna tube clips 1362 and 1364 for retaining antenna tube 1342. A button 1366, for activating a feature such as a memo recording feature of the device, and a light pipe 1368 are inserted into recesses 1372 and 1374 respectively of the rear housing portion 112. The rear housing portion includes an antenna receptacle 1370 having a threaded portion for receiving threaded portion 1311 of portion 1310.

The rear housing portion 112 further includes recesses 1376, 1378, 1380, and 1382. Snaps 1384 and 1386 extend through recesses 1380 and 1382 respectively. The snaps 1384 and 1386 engage hoops 1316 and 1318 respectively. Similar snaps are located within recesses 1376 and 1378, but are not visible.

A contact block 1387 is adapted to fit in a well 1388 having recesses 1389, 1390, and 1391. A vibrator 1392 and an associated grommet 1394 fits within a recess of contact block 1387. Recesses 1402, 1404, 1406, and 1408 enable access to contacts 1410, 1412, 1414, and 1416 respectively of the contact block. A contact portion 1418 and contact portion 1420 of the contact block are adapted to extend into recess 1401 to make contact to vibrator 1392 when the vibrator and grommet 1394 are inserted into contact block 1387. In particular, a first contact 1424 on the end of the vibrator and a second contact 1422 associated with the outer housing of the vibrator are coupled to contact portions 1420 and 1418 respectively. Finally, contact block 1387 is inserted into well 1388 by inserting a flange 1430 into a hook 1434 in the lower housing. Snaps 1396, 1397, and 1398 are then inserted into recesses 1389, 1390, and 1391 respectively as the contact block is pivoted into the well.

Figure 4:
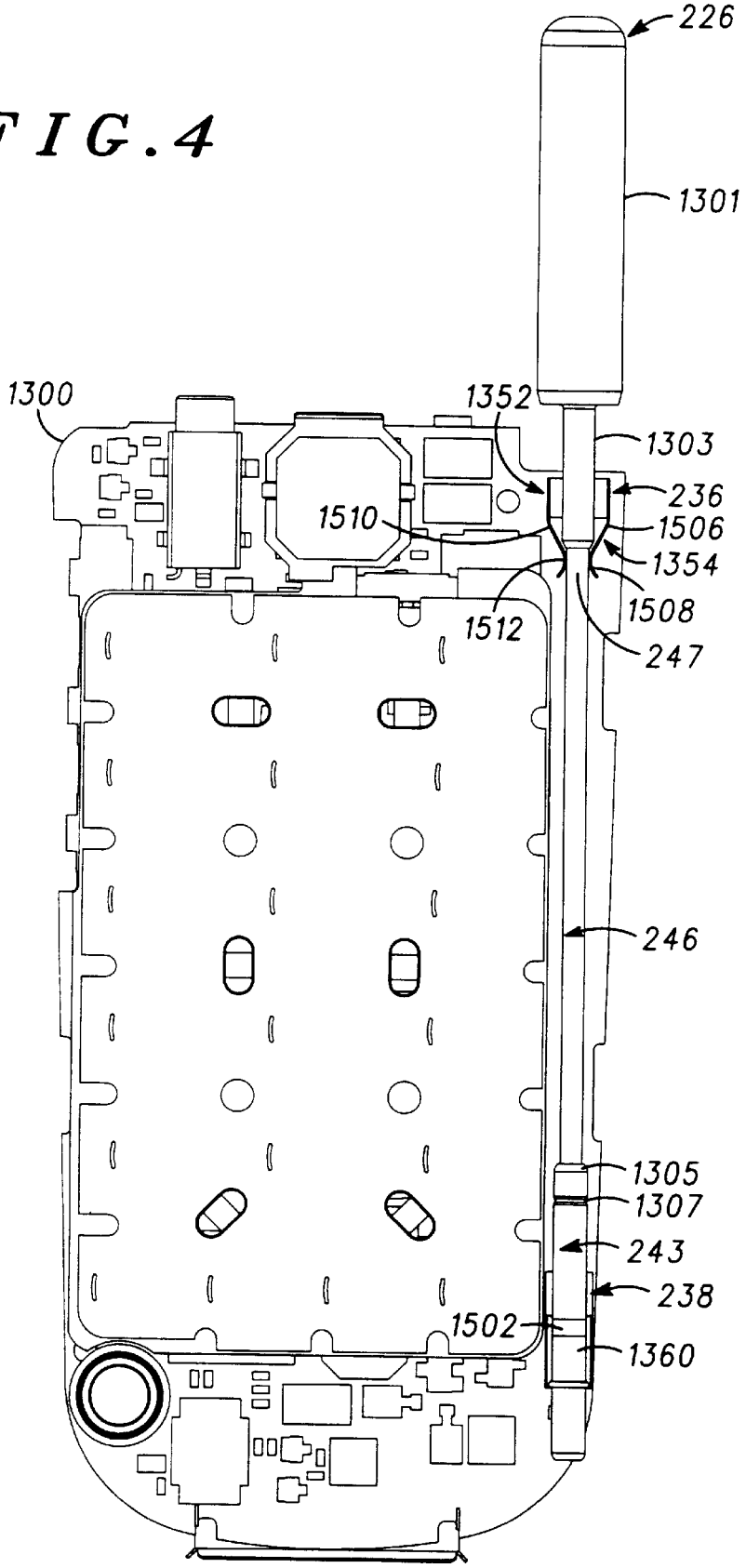
FIG. 4 is a top plan view of a circuit board showing an antenna in the down position according to the present invention.
Figure 5:
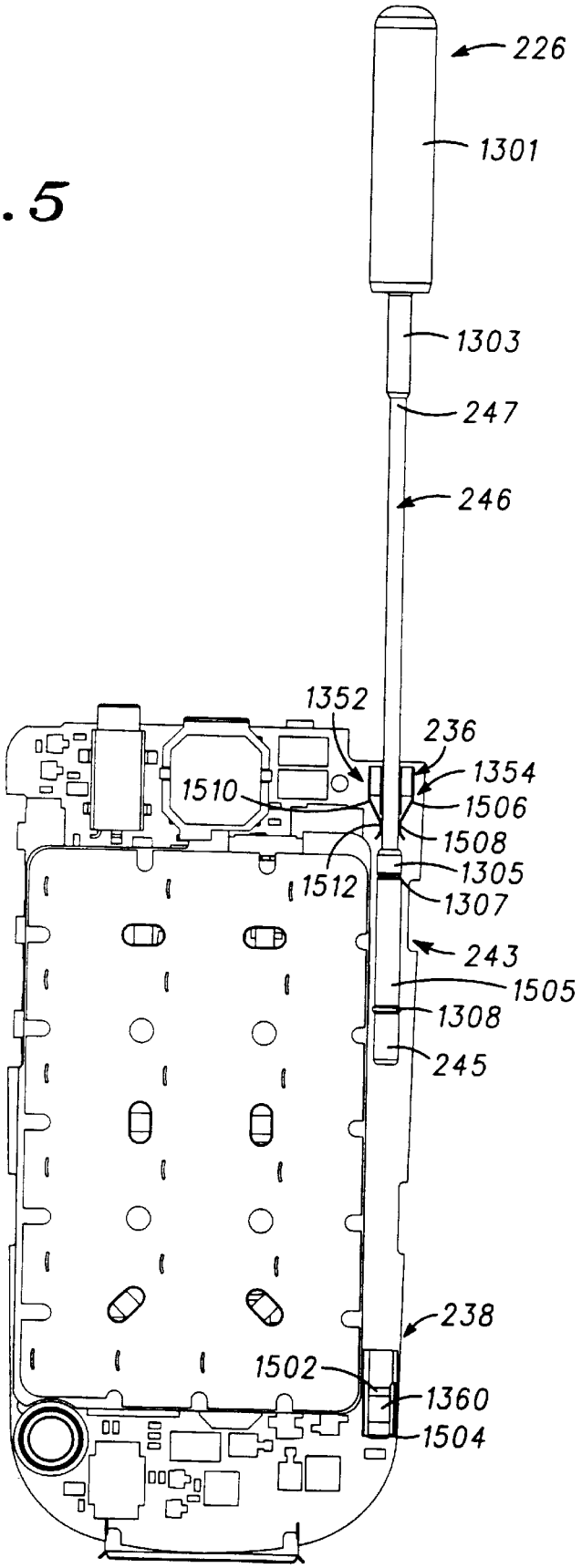
FIG. 5 is a top plan view of a circuit board showing an antenna in a partially up position according to the present invention.
Figure 6:
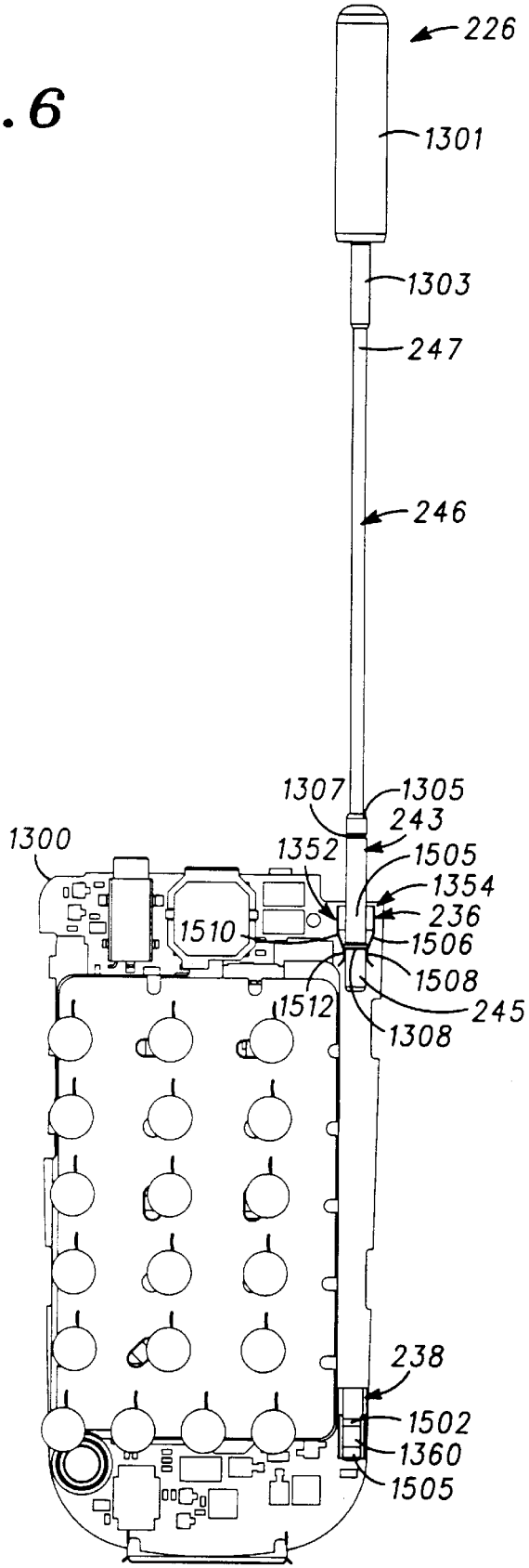
FIG. 6 is a top plan view of a circuit board showing an antenna in the up position according to the present invention.
Figure 8:
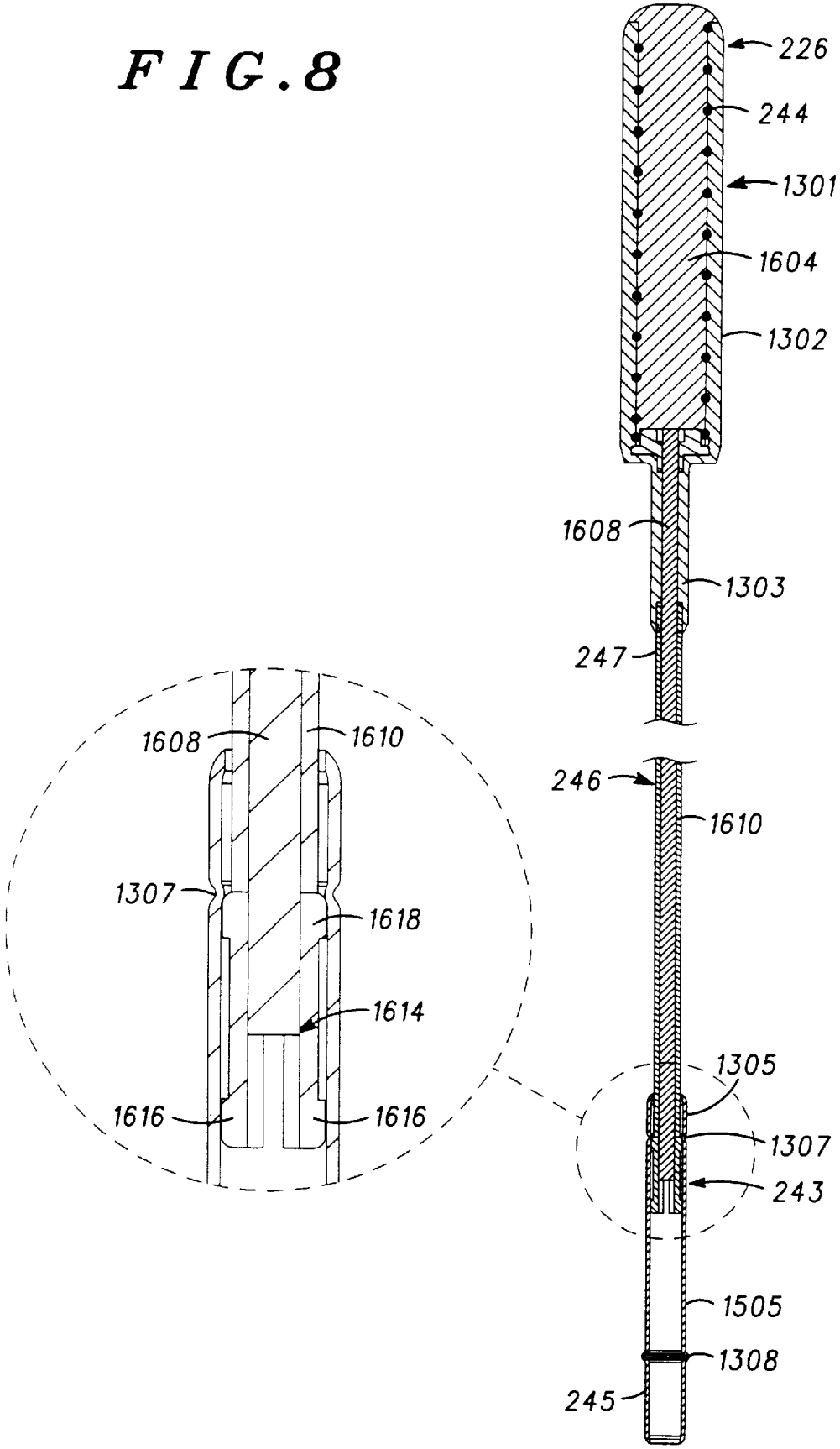
FIG. 8 is cross-sectional view of an antenna having a movable contact in a second position according to the present invention.

Turning now to FIG. 4, an antenna is shown in the down position attached to transceiver board 1300. In the down position, movable contact 243 is in contact with ground terminal 238. In particular, ground terminal 238 includes a bend 1502 and a contact portion 1504 for making an electrical connection to movable contact 243, in particular at a ground location 1505 above flange 1308. When antenna is in the retracted position as shown in FIG. 4, movable contact 243 is also shown in the retracted position. Signals from the antenna are capacitively coupled to transceiver board 1300 by way of feed terminal 236 at coupling location 247. As the antenna is moved upward, the movable contact is advanced towards feed terminal 236 as shown in FIG. 5. As the antenna is advanced further upward, the movable contact comes in contact with the feed terminal 236, until it is fully extended as shown in FIG. 6. That is, when the antenna is fully extended, the movable contact is also fully extended, as shown in FIG. 8.

Depending upon the friction force of the movable contact (described in more detail in FIG. 7) and the spring forces of first and second contact elements 1352 and 1354 of the feed terminal 236 and of upper contact portion 1360 of ground terminal 238, the top portion 1301 will extend further relative to the movable contact as the rod portion extends through the movable contact. That is, the spring pressure of upper contact portion 1360 of ground terminal 238 and the first and second contact elements of feed terminal 236 can be selected to enable the movable contact to be extended when in the down position as the antenna is initially advanced upward, or after the antenna has advanced and the movable contact has made contact with the upper contact, or a combination of both. Alternatively, the spring forces of the contacts and the friction force of the movable contact can be chosen such that the movable contact is not moved with respect to the rod portion until flange 1308 of movable contact makes contact with bushing 240 and the antenna is advanced to the fully extended position.

Figure 7:
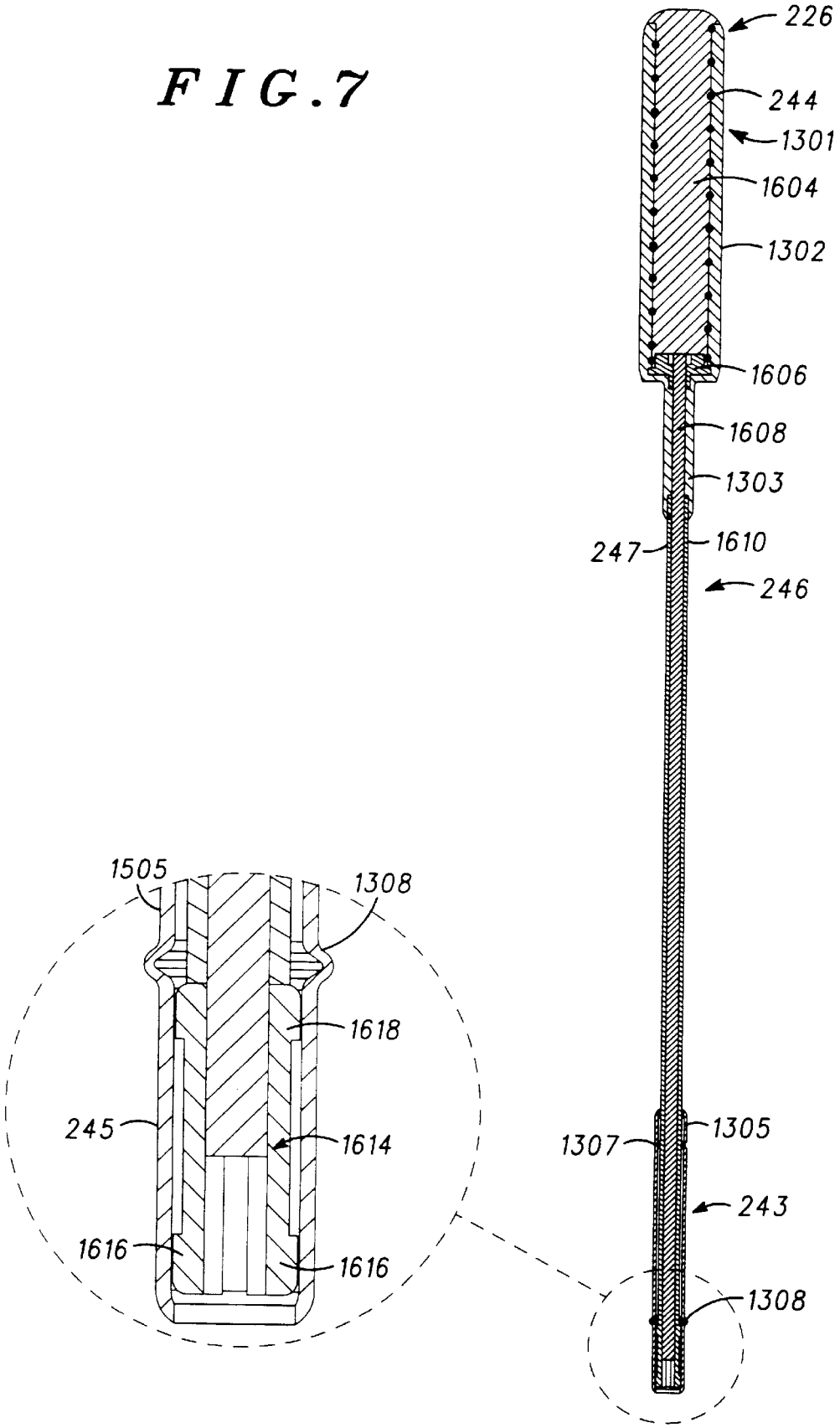
FIG. 7 is cross-sectional view of an antenna having a movable contact in a first position according to the present invention.

Turning now to FIG. 7, FIG. 7 shows an antenna with movable contact 243 in a collapsed position (when the antenna is in the down position or before the antenna is fully extended). As shown in the cross-sectional view of FIG. 7, a helical coil 244 is positioned within top portion 1301 of the antenna. The helical coil surrounds a dielectric material 1604, which provides support for the helical coil. The sleeve 1302 surrounds the helical coil and dielectric material and extends around a contact 1606 which connects the helical coil with an antenna element 1608. Sleeve 1302 extends to a lower sleeve portion 1303 below the top portion 1301. A sleeve 1610 extends below lower sleeve portion 1303 and covers antenna element 1608.

An enlarged view of movable contact 243 shows a pair of contacts 1614 having contact portions 1616 which make an electrical contact between antenna element 1608 and movable contact 243. Preferably, four contacts are evenly spaced around the rod, although any number of contacts could be employed. Each contact 1614 also includes a flange 1618 which stops the movement of the movable contact downward, as shown in FIG. 8. In particular, as the movable contact is moved downward by the force of either feed terminal 236, ground terminal 238 or bushing 240, each flange 1618 abuts shoulder portion 1307, preventing any further movement of the movable contact. As is apparent in FIG. 8, contact portion 1616 makes an electrical contact to movable contact 243 at a location near the top of movable contact 243, effectively extending the length of the antenna.

Also shown in FIG.s 7 and 8 is an upper portion 1305 which is included to minimize the movement of the movable contact when the movable contact is fully extended as shown in FIG. 8, such as when the antenna is bended. As stated earlier, flange 1308 prevents the antenna from being removed from the radiotelephone when bushing 240 is screwed into antenna receptacle 1370.

While particular embodiments of the present invention have been shown and described, modifications may be made. It is therefore intended in the appended claims to cover all such changes and modifications which fall within the true spirit and scope of the invention.

What is claimed is:

1. An antenna arrangement comprising:

a movable antenna element movable between an extended position and a retracted position;

a movable contact movably coupled to a bottom portion of said movable antenna element and formed to cover at least a part of said bottom portion, said movable contact being movable between an extended position and a retracted position; and a circuit board having a first contact element, and a second contact element coupled to ground, said first contact element receiving said movable contact when said movable antenna element is in an extended position, and said second contact element receiving said movable contact when said movable antenna element is in a retracted position for terminating the antenna.

2. The antenna arrangement of claim 1 further comprising a bushing movably coupled to said movable antenna element.

3. The antenna arrangement of claim 2 wherein said movable contact further comprises a flange which abuts said bushing when said movable antenna element is in the extended position.

4. The antenna arrangement of claim 3 wherein said movable contact further comprises a shoulder portion.

5. The antenna arrangement of claim 4 wherein said movable contact further comprises an upper portion above said shoulder portion.

6. The antenna arrangement of claim 2 further comprising a housing for receiving said circuit board, said housing having a threaded antenna receptacle for receiving said bushing.

7. An antenna arrangement comprising:

a movable antenna element movable between an extended position and a retracted position;

a bushing movably coupled to said movable antenna element;

a movable contact movably coupled to a bottom portion of said movable antenna element, said movable contact being movable between an extended position and a retracted position, and wherein said movable contact comprises:

a flange which abuts said bushing when said movable antenna element is in the extended position; and a shoulder portion;

a circuit board having a first contact element, and a second contact element coupled to ground, said first contact element receiving said movable contact when said movable antenna element is in an extended position, and said second contact element receiving said movable contact when said movable antenna element is in a retracted position for terminating antenna; and at least one contact element positioned within said movable contact, said at least one contact element having a flange for abutting said shoulder portion of said movable contact when said movable contact is in said extended position.

8. An antenna arrangement comprising:

a housing having a threaded antenna receptacle;

a first movable antenna element movable between an extended position and a retracted position;

a bushing movably coupled to said first movable antenna element, said bushing being threaded to mate with said threaded antenna receptacle;

a movable contact movably coupled to a bottom portion of said first movable antenna element and formed to cover at least a part of said bottom portion, said movable contact also being movable between an extended position an a retracted position; and a circuit board positioned within said housing and having a first contact element and a second contact element, said first contact element receiving said movable contact when said first movable antenna element is in an extended position and said second contact element receiving said movable contact when said first movable antenna element is in a retracted position.

9. The antenna arrangement of claim 8 wherein said movable contact further comprises a flange which abuts said bushing when said first movable antenna element is in the extended position.

10. The antenna arrangement of claim 9 wherein said movable contact further comprises a shoulder portion.

11. An antenna arrangement comprising:

a housing having a threaded antenna receptacle;

a first movable antenna element movable between an extended position and a retracted position;

a bushing movably coupled to said first movable antenna element, said bushing being threaded to mate with said threaded antenna receptacle;

a movable contact movably coupled to a bottom portion of said first movable antenna element, said movable contact also being movable between an extended position an a retracted position, and wherein said movable contact comprises:

a flange which abuts said bushing when said first movable antenna element is in the extended position;

a shoulder portion; and contact portions within said movable contact, said contact portions having a flange for abutting said shoulder portion; and a circuit board positioned within said housing and having a first contact element and a second contact element, said first contact element receiving said movable contact when said first movable antenna element is in an extended position and said second contact element receiving said movable contact when said first movable antenna element is in a retracted position.

12. An antenna arrangement comprising:

a housing having a threaded antenna receptacle;

a first movable antenna element movable between an extended position and a retracted position;

a bushing movably coupled to said first movable antenna element, said bushing being threaded to mate with said threaded antenna receptacle;

a movable contact movably coupled to a bottom portion of said first movable antenna element and formed to cover at least a part of said bottom portion, said movable contact also being movable between an extended position and a retracted position and comprising a flange which abuts said bushing when said first movable antenna element is in the extended position; and a circuit board positioned within said housing and having a first contact element and a second contact element, said first contact element receiving said movable contact when said first movable antenna element is in an extended position and said second contact element receiving said movable contact when said first movable antenna element is in a retracted position.

* * * * *